US005213123A

United States Patent [19]

Whitfield

[11] Patent Number: 5,213,123

[45] Date of Patent: May 25, 1993

[54] UMBRELLA

[75] Inventor: John Whitfield, Raleigh, N.C.

[73] Assignee: Louis Sammarco, Memphis, Tenn.

[21] Appl. No.: 756,910

[22] Filed: Sep. 9, 1991

[51] Int. Cl.[5] ..... A45B 25/02

[52] U.S. Cl. ..... 135/27; 135/33.2

[58] Field of Search ..... 135/27, 33.41, 33.2, 135/33.31, 33.32, 25.31

[56] References Cited

U.S. PATENT DOCUMENTS

| | | | |
|---|---|---|---|
| 229,752 | 7/1880 | Ray . | |
| 341,192 | 5/1886 | Webster . | |
| 350,030 | 9/1886 | Apfelbaum | 135/33.2 |
| 475,072 | 5/1892 | Witt | 135/33.41 |
| 491,805 | 2/1893 | Lincke . | |
| 559,577 | 5/1896 | Hadfield | 135/27 |
| 588,773 | 8/1897 | Mitchell | 135/33.41 |
| 1,036,142 | 8/1912 | Parker . | |
| 2,076,525 | 4/1937 | Bouma . | |
| 2,168,188 | 8/1939 | Bernhard . | |
| 3,785,388 | 1/1974 | Schafer . | |
| 3,861,410 | 1/1975 | Cognet . | |
| 3,921,655 | 11/1975 | Weber . | |
| 3,930,514 | 1/1976 | Wu | 135/27 |
| 4,368,749 | 1/1983 | Lindler . | |
| 4,601,301 | 7/1986 | Hermanson . | |
| 4,624,275 | 11/1986 | Baldwin . | |
| 4,880,023 | 11/1989 | Lin . | |

FOREIGN PATENT DOCUMENTS

| | | | |
|---|---|---|---|
| 221496 | 4/1910 | Fed. Rep. of Germany | 135/25.31 |
| 9240 | 10/1894 | Switzerland | 135/27 |
| 121459 | 8/1926 | Switzerland | 135/27 |
| 341 | of 1870 | United Kingdom | 135/33.2 |
| 1378272 | 12/1974 | United Kingdom | 135/27 |

*Primary Examiner*—Henry E. Raduazo
*Attorney, Agent, or Firm*—R. Neil Sudol; Henry D. Coleman

[57] ABSTRACT

An umbrella comprises a foldable frame and a web provided having a substantially circular central portion and a substantially annular skirt portion continuous with the central portion. The frame comprises a rigid support shaft, a plurality of ribs pivotably attached to the support shaft at one end thereof, a runner element slidably attached to the shaft, and a plurality of stretcher arms each pivotably fastened at one end to the runner element and at an opposite end to a respective one of the ribs. In addition, the frame includes a plurality of skirt support members each pivotably attached to a free end of a respective one of the ribs, and a plurality of pulling members each pivotably attached at one end to a respective one of the stretcher arms and at an opposite end to a respective one of the skirt support members. The skirt portion of the cover or web is fastened to the skirt support members.

13 Claims, 4 Drawing Sheets

UMBRELLA

BACKGROUND OF THE INVENTION

This invention relates to an umbrella or parasol.

Umbrellas have long served to protect the human body from the sun or the rain. Umbrellas are preferably foldable, attractive, and resistant to inversion or collapse in the wind. Although foldable umbrellas are well known, the prior art does not provide a versatile device that will resist wind inversion and yet have the aesthetic appeal of a flat top umbrella or parasol. Traditional umbrellas are generally of a parabolic or dome-like shape.

OBJECTS OF THE INVENTION

An object of the present invention is to provide an umbrella which has an improved resistance to inversion or collapse, for example, in strong winds.

Another object of the present invention is to provide an improved umbrella which has a distinctive and attractive appearance.

Another, more particular, object of the present invention is to provide an improved flat top umbrella.

Another particular object of the present invention is to provide an umbrella with a distinctive appearance which renders it especially suitable for advertising purposes.

A further object of the particular invention is to provide a sturdy flat-top umbrella which has a simple construction.

SUMMARY OF THE INVENTION

An umbrella comprises, in accordance with a first conceptualization of the present invention, a web having a central portion and a substantially annular skirt portion continuous with the central portion, a rigid support shaft, and a foldable frame. The frame includes a first support assembly operatively connected to the shaft for spreading or stretching the central portion from a folded storage configuration into an opened or use configuration during an opening of the umbrella and for supporting the central portion in the opened configuration upon an opening of the umbrella. The frame further includes a second support assembly operatively connected to the shaft for drawing the skirt portion, during an opening of the umbrella, into an orientation angled with respect to the opened configuration of the central portion and coaxial with the shaft and for supporting the skirt portion in the angled orientation upon an opening of the umbrella. Crimping elements are provided for forming in the skirt portion a plurality of cross-sectionally V-shaped ridges spaced about the skirt portion.

An umbrella in accordance with the present invention resembles a bottle cap, particularly a traditional cap for a carbonated beverage bottle. The V-shaped ridges on the skirt portion of the umbrella web extend in respective axial or longitudinal planes angularly spaced from each other and are preferably angularly equispaced with respect to one another, whereby the ridges simulate or resemble crimps on a bottle cap.

An umbrella comprises, in accordance with another conceptualization of the present invention, a foldable frame and a web provided having a central portion and a substantially annular skirt portion continuous with the central portion. The frame comprises a rigid support shaft, a plurality of ribs pivotably attached to the support shaft at one end thereof, a runner element slidably attached to the shaft, and a plurality of stretcher arms each pivotably fastened at one end to the runner element and at an opposite end to a respective one of the ribs. In addition, the frame includes a plurality of skirt support members each pivotably attached to a free end of a respective one of the ribs, and a plurality of pulling members each pivotably attached at one end to a respective one of the stretcher arms and at an opposite end to a respective one of the skirt support members. The skirt portion of the cover or web is fastened to the skirt support members.

The stretcher arms function to pivot the ribs about the one end of the umbrella shaft upon a sliding of the runner element. During an opening stroke of the runner element, the pulling members serve to pivot the skirt support members about their respective points of attachment to the free ends of the umbrella ribs and further serve to maintain the skirt support members in a downwardly depending configuration during use of the umbrella.

Pursuant to another feature of the present invention, a plurality of flexible tensile elements are provided, each extending from the runner element to a respective one of the skirt support members. The tensile elements function to strengthen the umbrella by forming, together with the rigid members of the umbrella frame, a triangulated truss work. Each of the tensile elements is preferably connected to the respective one of the skirt support members at a coupling point or pivot pin connecting such skirt member to a respective one of the pulling members.

In an umbrella in accordance with the present invention, a plurality of string-like elements are advantageously provided, each extending from a respective one of the stretcher arms to a respective one of the tensile elements. These string-like elements facilitate folding of the tensile elements during a collapse of the umbrella. Each of the string-like elements is preferably connected to the respective one of the stretcher arms at a coupling point connecting such stretcher arm to a respective one of the pulling members.

Pursuant to another feature of the present invention, the skirt portion of the umbrella cover or web is provided with a plurality of pockets spaced circumferentially about the skirt portion. Each of the pockets receives a crimping element in the form of a plate or shield element which is preferably made from a substantially triangular plate member bent along an axis of symmetry to form two substantially triangular wing portions oriented at an angle with respect to one another. The bent plate members shape the skirt portion of the umbrella top or web to form a series of ridges analogous to crimps in a bottle cap, particularly a traditional carbonated beverage bottle cap. The umbrella thus assumes the appearance of a bottle cap, which is not only novel and attractive but also makes the umbrella particularly suitable for the advertising of bottled products.

An umbrella frame in accordance with the present invention has specific geometric relationships which enable proper folding and unfolding of the umbrella. Each of the pulling members is attached to the respective skirt support member at a first distance from the free end of the respective rib, while each of the stretcher arms is attached to the respective rib at a point of attachment lying at a second distance from the free end of the respective rib. Each of the pulling members is attached to the respective stretcher arm at a third distance from the point of attachment of that stretcher arm to the respective rib. Each pulling arm has a length which, when added to the third distance, is at least approximately equal to the sum of the first distance and the second distance.

An umbrella in accordance with the present invention is particularly strong and resistant to inversion from the wind. The support is achieved via a triangulated arrangement of components in the manner of a truss work. Such a structure is stronger than conventional cantilevered umbrella frames. The truss work umbrella frame may be adapted for use in a flat top umbrella or may be used in a more conventional dome-type or parabolic umbrella. In either case, the skirt portion of the umbrella top preferably forms a distinct angle with the central portion of the umbrella top.

DETAILED DESCRIPTION

Figure 1:
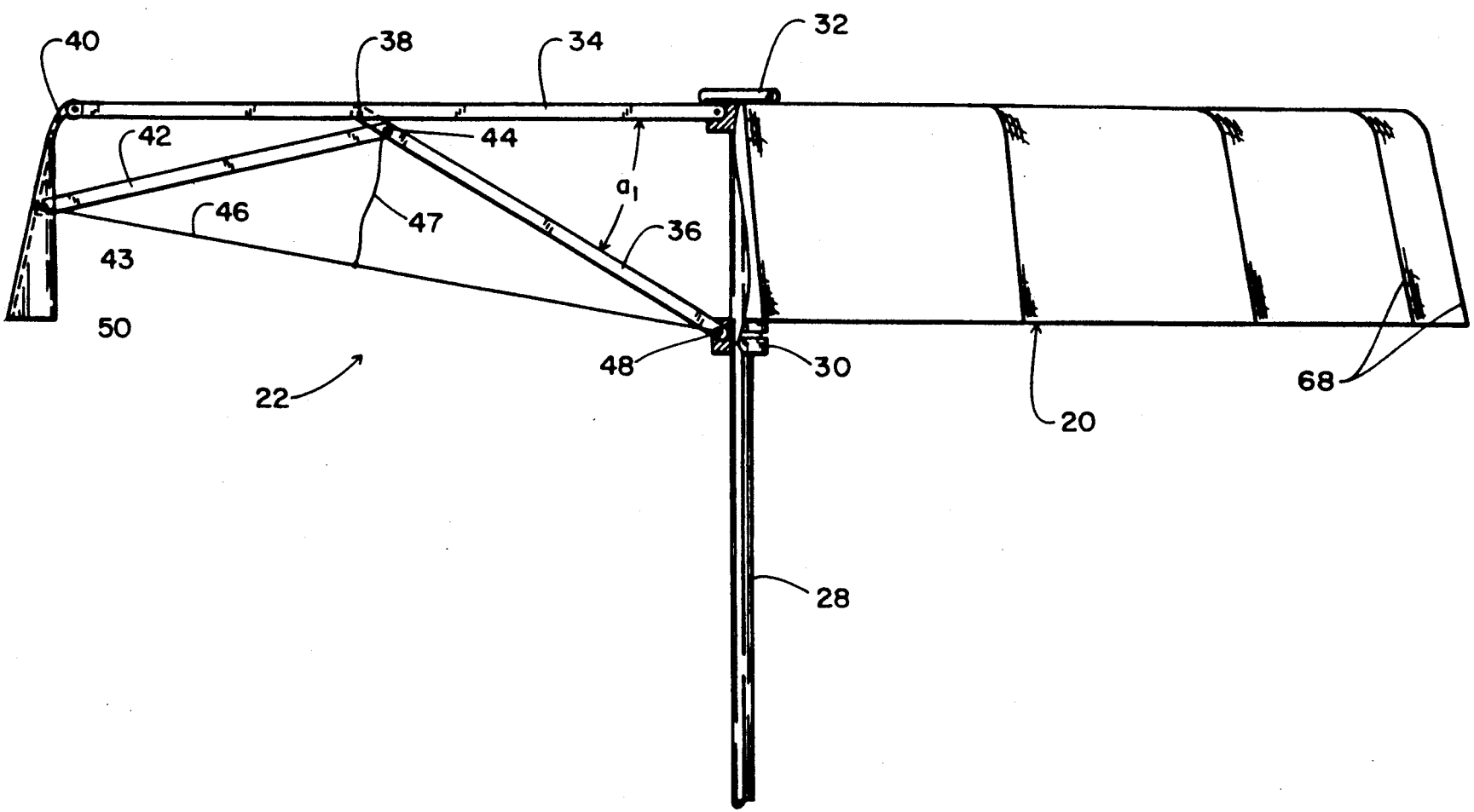
FIG. 1 is a side elevational view, partly broken away, of an umbrella in accordance with the present invention, showing the umbrella in an opened configuration.
Figure 2:
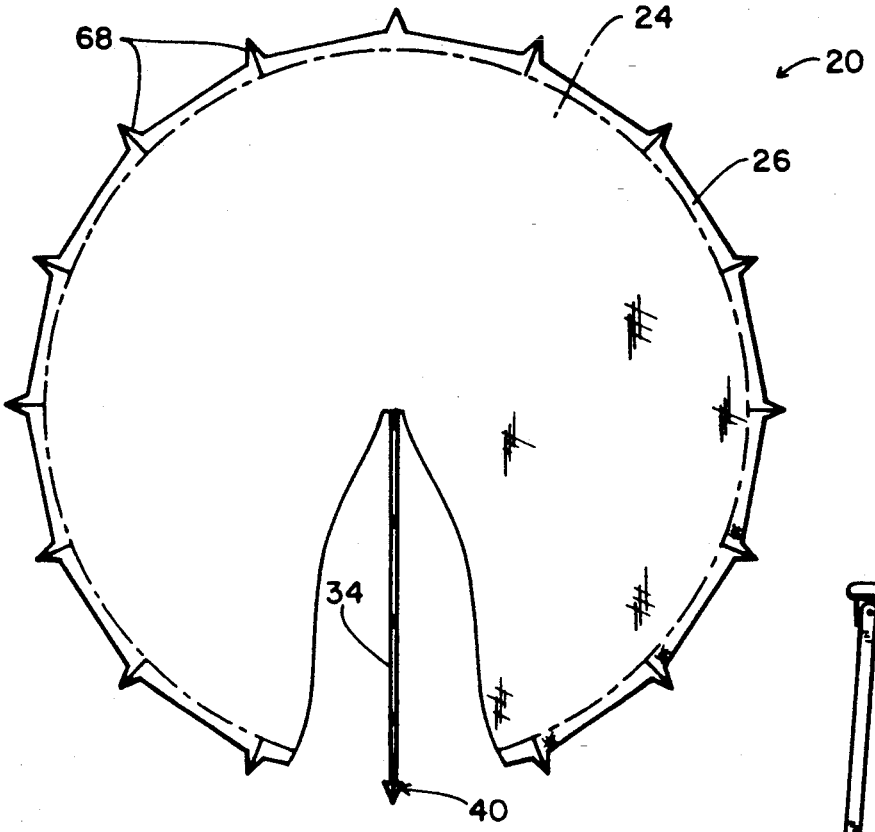
FIG. 2 is a top view, partly broken away, of the umbrella of FIG. 1.

As illustrated in FIGS. 1 and 2, an umbrella comprises a web 20 of flexible water-resistant material fastened to a frame assembly 22. Web 20 comprises a circular top portion 24 (see also FIG. 8) and an annular skirt portion 26 which depends downwardly from the top portion in the opened configuration of the umbrella, as illustrated in FIG. 1.

The umbrella further comprises a shaft member 28 to which an annular runner element 30 is slidably fastened. At an upper end, shaft 28 carries a hub 32 to which a plurality of substantially rigid elongate ribs or spokes 34 are pivotably connected. In the opened configuration of the umbrella (FIG. 1), ribs 34 extend substantially perpendicularly and radially with respect to shaft 28 and are angularly equispaced from one another.

A plurality of substantially rigid elongate stretcher arms 36 are each pivotably fastened at one end to runner 30 and at an opposite end to a respective rib 34 at a coupling point or pivot pin 38. Stretcher arms 36 are angularly equispaced about runner 30 and are aligned with the respective ribs 34. In the opened configuration of the umbrella (FIG. 1), each stretcher arm 36 forms an acute angle $a_1$ with the respective rib 34, while in the closed or collapsed configuration of the umbrella (FIG. 3), each stretcher arm 36 forms an obtuse angle $a_2$ with the respective rib 34.

Figure 3:
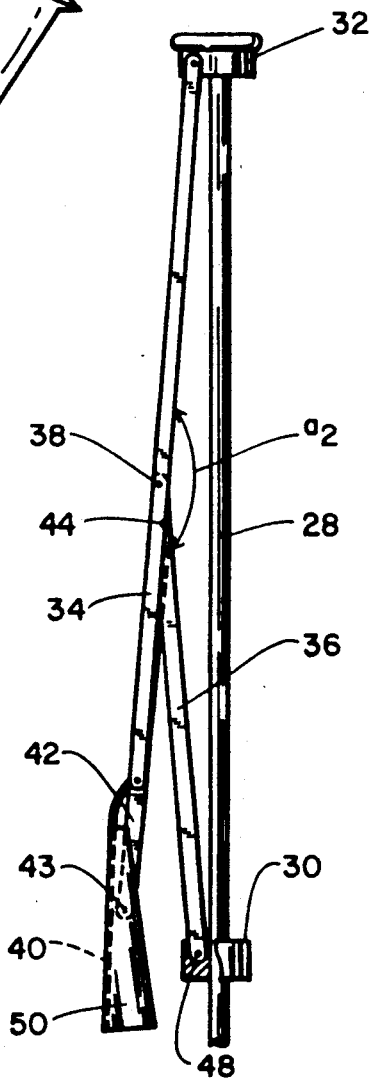
FIG. 3 is a side elevational view of a portion of a frame assembly in the umbrella of FIGS. 1 and 2, showing the frame assembly in a closed or collapsed configuration.
Figure 7:
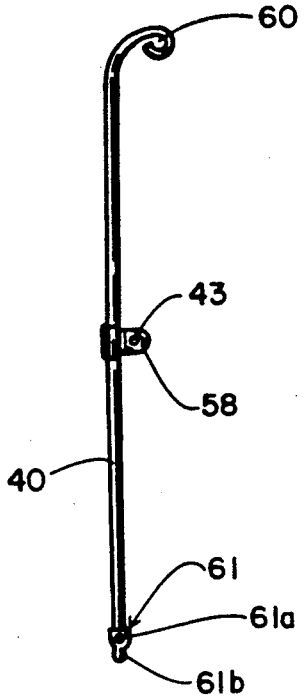
FIG. 7 is a side view of a rod member included as a component of the skirt support member of FIGS. 1–5.

A plurality of skirt support members 40 in the form of rods (see FIG. 7) equal in number to ribs 34 are pivotably attached to the free ends of respective ribs 34. A like plurality of substantially rigid elongate coupling members 42 are each pivotably connected at one end to respective skirt support rods 40 and at an opposite end to respective stretcher arms 36. Coupling members 42 serve to pull skirt supports or rods 40 from an extended position, which is substantially parallel to or aligned with the respective rib 34 in the closed storage configuration of the umbrella, as depicted in FIG. 3, to a downwardly angled position in the opened or use configuration of the umbrella, as shown in FIG. 1.

Figure 4:
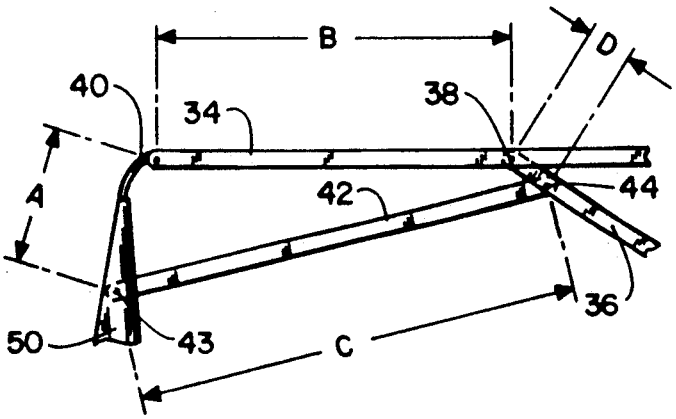
FIG. 4 is a side elevational view of a smaller portion of the frame assembly in the umbrella of FIGS. 1–3, showing the frame assembly in the opened configuration and indicating lengths and distances of different components of the frame assembly.

As illustrated in FIG. 4, each coupling or pulling member 42 is attached to the respective skirt support rod 40 at coupling point or pivot pin 43 located a distance A from the free end of the respective rib 34. As described hereinabove, the associated stretcher arm 36 is attached to that rib 34 at coupling point or pivot pin 38 which is located at a distance B from the free end of the rib. The coupling member 42 is connected to the respective stretcher arm 36 at a coupling point or pivot pin 44 located a distance D from coupling point 38. The coupling member 42 has an effective length C (measured from pivot pin 43 to coupling point 44) which, when added to distance D is at least approximately equal to the sum of the distances A and B. Because of these dimensional relationships, skirt support rod 40 is substantially aligned with rib 34 in the closed configuration of the umbrella (FIG. 3).

As illustrated in FIG. 1, frame assembly 22 is provided with a plurality of tensile elements 46 (e.g., strings or cords), preferably equal in number to ribs 34. Each cord 46 is connected at a radially inner end to runner 30 and, more particularly, to a pivot pin 48 which connects the respective stretcher arm 36 to runner 30. At a radially outer end, each cord 46 is connected to coupling point or pivot pin 43.

As further illustrated in FIG. 1, frame assembly 22 is also provided with a plurality of additional string-like elements 47 each connected at one end to a respective coupling point or pivot pin 44 and at an opposite end to a respective cord 46. String-like elements 47 serve as retainers facilitating the folding of cords 46 during a closing of the umbrella.

Cord 46 acts as a tension link to form a triangle with stretcher arm and a triangular component formed substantially by rib 34, skirt support rod 40 and coupling member. This triangle, together with the triangle formed by umbrella shaft 28, rib 34 and stretcher arm 36, constitutes a triangulated trusswork which greatly strengthens the umbrella against inversion in windy conditions. The three triangles are triangular truss components of a foldable linkage pivotally attached to the shaft 28 at one end thereof and to runner element 30.

Figure 5:
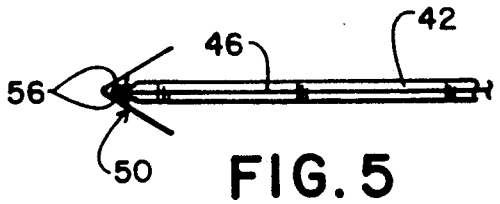
FIG. 5 is a bottom view of a skirt support member, a coupling arm and a tensile element connected thereto in the frame assembly of FIGS. 1–4.
Figure 6:
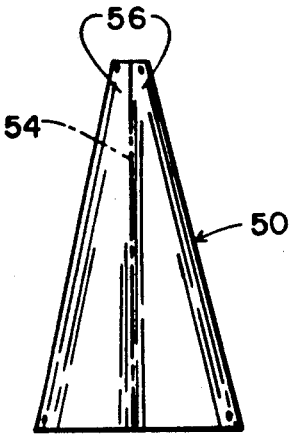
FIG. 6 is a side view of a plate member included as a component of the skirt support member of FIGS. 1–5.

FIG. 5 is a bottom view of skirt support rod 40 and its respective coupling member 42. In addition, FIG. 5 illustrates a an umbrella top crimping member in the form of a substantially triangular plate 50 shown in an unbent configuration in FIG. 6. Triangular plate 50 is bent along an axis of symmetry 54 to form a pair of wings 56 oriented at a substantially 45° angle with respect to one another.

As depicted in FIGS. 1 and 3, skirt support rod 40 is disposed between wings 56, in the angle or channel defined thereby. Rod 40 (see FIG. 7) is formed with a flange 58 to which coupling member 42 is connected at coupling point or pivot pin 43. Rod 40 is further formed at one end with a hook or pivot pin portion 60 which connected to the free end of the respective rib 34. At an opposite end, skirt support rod 40 is provided with a formation 61 for facilitating the attachment of umbrella top skirt portion 26 to the skirt support rod. Formation 61 may take any conventional form such as an eyelet 61*a* for receiving a thread or, alternatively, an extension 61*b* for receiving a cap (not shown).

Figure 8:
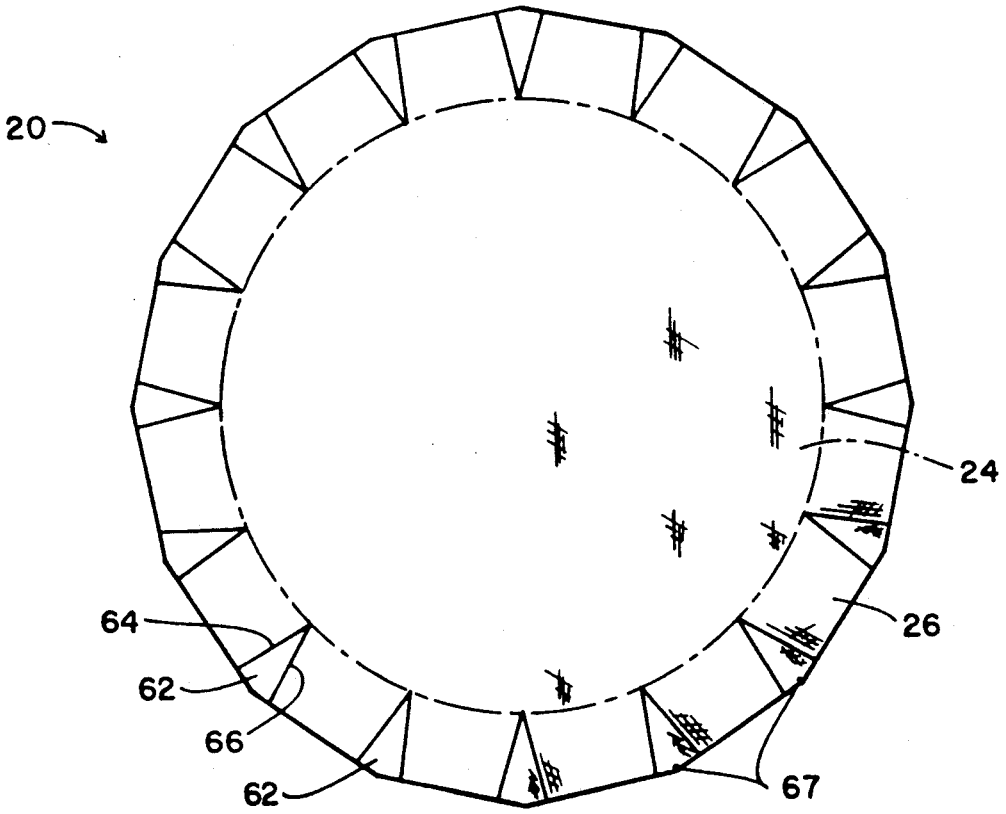
FIG. 8 is a bottom view of an umbrella top or web of the umbrella of FIGS. 1 and 2, showing the web in a pre-assembly, spread-out configuration.

As illustrated in FIG. 8, web 20 is provided along skirt portion 26 with a plurality of angularly or circumferentially equispaced triangular pockets 62 for receiving respective triangular plates 50. Each pocket 62 is formed by a double layer of top material. Pockets 62 are slightly larger than and preferably geometrically similar to plates 50. Each pocket 62 is stitched or otherwise connected to skirt portion 26 of umbrella top or web 20 along at least two sides 64 and 66.

As best seen in FIG. 2, plates 50, when bent to form wings 56 and inserted into pockets 62 of umbrella top or web 20, define a series of ridges 68 about the web skirt portion 26, particularly in the opened configuration of the umbrella, as illustrated in FIGS. 1 and 2. Ridges 68 crimp the material of umbrella top skirt portion 26 and thereby simulate the crimps of a bottle cap, particularly a traditional carbonated beverage bottle cap (not illustrated).

Crimping plates 50 form in skirt portion 26 a plurality of cross-sectionally V-shaped ridges spaced about the skirt portion. The V-shaped ridges extend in respective axial or longitudinal planes angularly spaced from each other and are preferably angularly equispaced with respect to one another.

It is to be noted that plates 50, as well as ribs 34, coupling or pulling members 42 and the other elements of the umbrella frame 22, may be made of either a hard polymeric or a metallic material.

During manufacture of an umbrella in accordance with the invention, the frame assembly 22, including skirt support rods 40, is assembled separately from umbrella web 20. Triangular plates 50 are bent and inserted into pockets 62 of umbrella top skirt portion 26. Skirt portion 26 is then connected to rod attachment formations 61 (FIG. 7) at a plurality of angularly spaced apart points 67 (FIG. 8). In addition, central portion 24 of web 20 is connected to shaft member 28 at hub 32.

Figure 9:
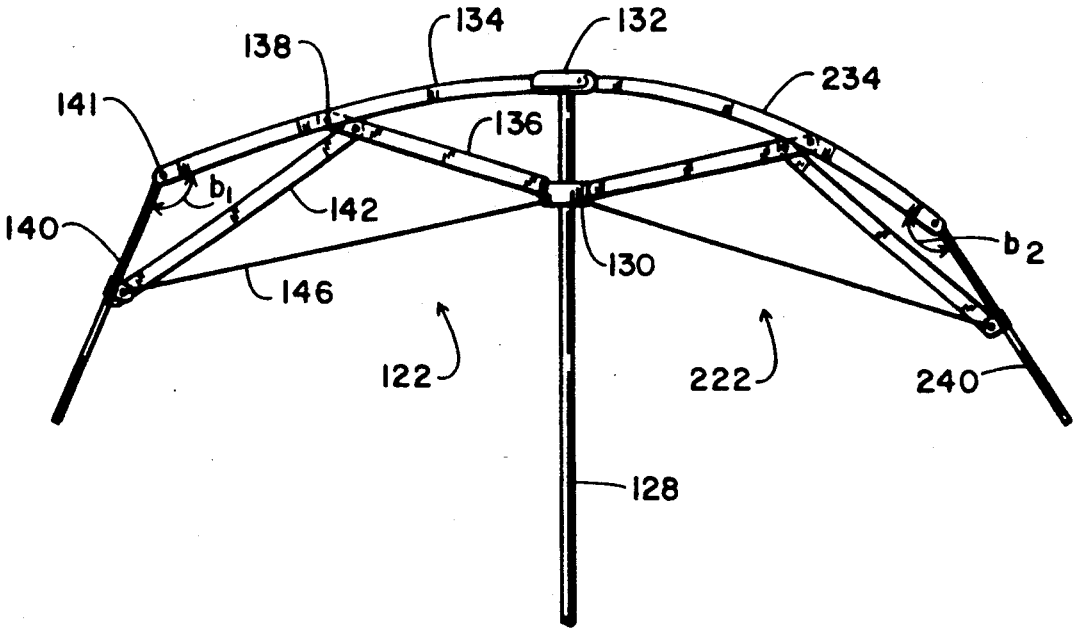
FIG. 9 is a schematic side elevational view of two additional embodiments of an umbrella frame in accordance with the present invention, showing application of the invention to parabolic or dome-type umbrellas.

As illustrated in FIG. 9, another umbrella frame assembly 122 comprises a shaft member 128 to which an annular runner element 130 is slidably fastened. At an upper end, shaft 128 carries a hub 132 to which a plurality of flexible elongate ribs or spokes 134 are pivotably connected. In the opened configuration of the umbrella shown at the left side in FIG. 9, ribs 134 extend in a substantially parabolic arc from hub 132 and are angularly equispaced from one another. A plurality of substantially rigid elongate stretcher arms 136 are each pivotably fastened at one end to runner 130 and at an opposite end to a respective rib 134 at a coupling point or pivot pin 138. Stretcher arms 136 are angularly equispaced about runner 130 and are aligned with the respective ribs 134. A plurality of skirt support members 140 in the form of rods equal in number to ribs 134 are pivotably attached to the free ends of respective ribs 134. A like plurality of substantially rigid elongate coupling members 142 are each pivotably connected at one end to respective skirt support rods 140 and at an opposite end to respective stretcher arms 136. Coupling members 142 serve to pull skirt supports or rods 140 from an extended position, which is substantially parallel to or aligned with the respective rib 134 in the closed storage configuration of the umbrella to a downwardly angled position in the opened or use configuration of the umbrella. Frame assembly 122 is further provided with a plurality of tensile elements 146 (e.g., strings or cords), preferably equal in number to ribs 134. Each cord 46 is connected at a radially inner end to runner 130 and, more particularly, to a pivot pin (not shown) which connects the respective stretcher arm 136 to runner 130. At a radially outer end, each cord 146 is connected to a respective skirt support rod 140. Cords 146 each act as a tension link to form a triangle with the respective stretcher arm 136 and coupling member 142. This triangle, together with the triangle formed by umbrella shaft 128, rib 134 and stretcher arm 136, constitutes a truss type of configuration to strengthen the umbrella against inversion.

The right side of FIG. 9 depicts a frame assembly 222 which is similar in structure to frame assemblies 22 (FIG. 1) and 122 (left side of FIG. 9) but is not as sturdy as frame assemblies 22 and 122. Frame assembly 222 forms an umbrella having a more traditional parabolic or dome-type shape wherein skirt support rods 240 form with the outer ends of ribs 234 an angle $b^2$ which is nearly 180°. In contrast, skirt support rods 140 and respective ribs 134 of frame assembly 122 include an angle $b^1$ which is significantly less than 180° and thereby defines a sharp point or edge 141 at the junction of rib 134 and rod 140.

Figure 10:
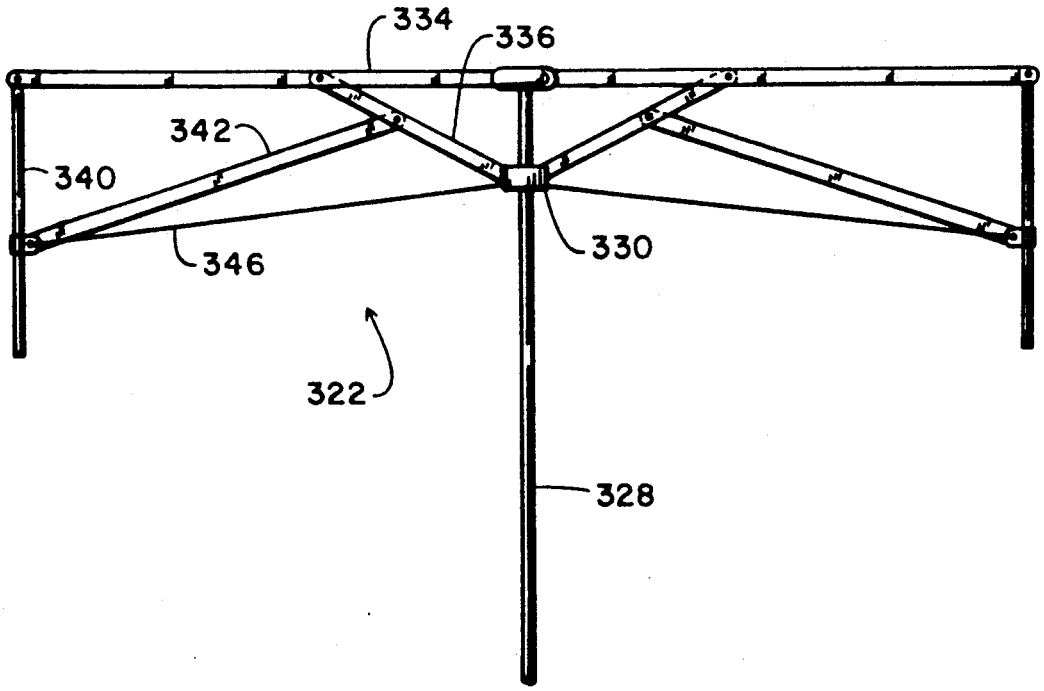
FIG. 10 is a schematic side elevational view of yet another embodiment of an umbrella frame in accordance with the present invention.

In another umbrella, shown in FIG. 10, a frame assembly 322 has ribs 334 which extend in a planar configuration perpendicularly to a support shaft 328. Ribs 334 are supported in that planar configuration by respective stretcher arms 336. Coupling members 342 are each connected at an inner side to stretcher arms 336 and at an outer side to skirt support rods 340. Rods 340 are pivotably connected to the free ends of respective ribs 334 and depend perpendicularly with respect to the ribs. Tension cords 346 extend from a runner 330 on shaft 328 to the coupling point or junction of skirt support rods 340 and coupling members 342.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

What is claimed is:

1. An umbrella comprising:

a foldable frame including:

(i) a rigid support shaft;

(ii) a plurality of ribs pivotably attached to said support shaft at one end thereof;

(iii) a runner element slidably attached to said shaft;

(iv) a plurality of stretcher arms each pivotably fastened at one end to said runner element and at an opposite end to a respective one of said ribs;

(v) a plurality of skirt support members each pivotably attached to a free end of a respective one of said ribs;

(vi) a plurality of pulling members each pivotally attached at one end to a respective one of said stretcher arms and at an opposite end to a respective one of said skirt support members; and (vii) a plurality of flexible tensile elements each fixed at one end to said runner element and at an opposite end to a respective one of said skirt support members essentially at a coupling point connecting same to a respective one of said pulling members, each of said tensile elements forming, with a respective stetcher arm and a respective pulling member, a triangular component of a truss; and a web having a central portion and a substantially annular skirt portion continuous with said central portion, said skirt portion being fastened to said skirt support members.

2. The umbrella defined in claim 1, further comprising a plurality of string-like elements each extending from a respective one of said stretcher arms to a respective one of said tensile elements.

3. The umbrella defined in claim 2 wherein each of said string-like elements is connected to the respective one of said stretcher arms at a coupling point connecting such stretcher arm to a respective one of said pulling members.

4. The umbrella defined in claim 1 wherein said skirt portion is provided with a plurality of pockets spaced circumferentially about said skirt portion, further comprising a plurality of angled crimping elements, each of said crimping elements being inserted into a respective one of said pockets to form a ridge in said skirt portion.

5. The umbrella defined in claim 4 wherein each of said crimping elements is made from a substantially triangular plate member bent along an axis of symmetry to form two substantially triangular wing portions oriented at an angle with respect to one another.

6. The umbrella defined in claim 1 wherein said skirt support members take the form of rod elements, each of said rod elements being pivotably attached to a free end of a respective one of said ribs, said skirt portion being fastened to each of said rod elements at a free end thereof.

7. The umbrella defined in claim 1 wherein each of said pulling members is attached to the respective one of said skirt support members at a first distance from the free end of the respective one of said ribs, each of said stretcher arms being attached to the respective one of said ribs at a point of attachment lying at a second distance from the free end of the respective one of said ribs, each of said pulling members being attached to the respective one of said stretcher arms at a third distance from the point of attachment of that stretcher arm to the respective one of said ribs, each of said pulling arms having a length which, when added to said third distance is at least approximately equal to the sum of said first distance and said second distance.

8. The umbrella defined in claim 1 wherein said ribs are elongate and straight, whereby the umbrella takes the form of a flat top umbrella.

9. The umbrella defined in claim 8 wherein said stretcher arms have lengths and points of attachment to the respective ribs so that said ribs extend substantially perpendicularly to said shaft in an opened configuration of the umbrella.

10. An umbrella comprising:

a collapsible frame including:

(a) a rigid support shaft;

(b) a runner element slidably attached to said shaft;

(c) a plurality of foldable linkages angularly equispaced about said shaft, each of said linkages being pivotably attached to said shaft at one end thereof and to said runner element, each of said linkages including a triangulated trusswork with:

a first substantially triangular truss component including three substantially rigid members pivotably connected to each other;

a second substantially triangular truss component including three substantially rigid members pivotably connected to each other;

a third substantially triangular truss component including two substantially rigid members one in common with one of the rigid members of said first substantially triangular truss component and another in common with one of the rigid members of said second substantially triangular truss component, said third substantially triangular truss component further including a flexible tensile element connected at opposite ends to ends of said two substantially rigid members; and a web attached to each of said foldable linkages.

11. The umbrella defined in claim 10 wherein said first substantially triangular truss component and said second substantially triangular truss component have a substantially rigid member in common.

12. The umbrella defined in claim 11 wherein the common rigid member of said first substantially triangular truss component and said second substantially triangular truss component is a rib pivotably connected to said shaft, said first substantially triangular truss component being coextensive with a first portion of said rib and said second substantially triangular truss component being coextensive with a second portion of said rib essentially different from said first portion.

13. The umbrella defined in claim 10 wherein each of said foldable linkages includes;

(i) a rib pivotably attached to said support shaft at said one end thereof;

(ii) a stretcher arm pivotably fastened at one end to said runner element and at an opposite end to said rib;

(iii) a skirt support member pivotably attached to a free end of said rib; and (iv) a pulling member pivotably attached at one end to said stretcher arm and at an opposite end to said skirt support member;

said rib, said stetcher arm and said shaft defining said first substantially triangular truss component, said rib, said skirt support member and said pulling member defining said second substantially triangular truss component, and said stretcher arm, said pulling member and said tensile element defining said third substantially triangular truss component.

* * * * *